United States Patent [19]

Block

[11] 4,293,971

[45] Oct. 13, 1981

[54] FLOOR TREATING MACHINE WITH SQUEEGEE

[75] Inventor: Thomas S. Block, Muskegon, Mich.

[73] Assignee: Clarke-Gravely Corporation, Muskegon, Mich.

[21] Appl. No.: 49,884

[22] Filed: Jun. 19, 1979

[51] Int. Cl.[3] ..... A47L 9/02

[52] U.S. Cl. ..... 15/98; 15/320; 15/359

[58] Field of Search ..... 15/50 R, 50 C, 50 A, 15/51, 52, 98, 320, 321, 359, 360, 354

[56] References Cited

U.S. PATENT DOCUMENTS

| | | | |
|---|---|---|---|
| 1,904,972 | 4/1933 | Willis . | |
| 1,995,084 | 3/1935 | Wiehle . | |
| 3,021,550 | 2/1962 | Stratford | 15/359 |
| 3,065,490 | 11/1962 | Arones | 15/359 |
| 3,206,787 | 9/1965 | Daniels et al. . | |
| 3,277,511 | 10/1966 | Little et al. . | |
| 3,290,716 | 12/1966 | Cain . | |
| 3,376,597 | 4/1968 | Boyd | 15/320 |
| 3,649,995 | 3/1972 | Ison | 15/320 |
| 3,722,025 | 3/1973 | Gledhill | 15/359 |
| 3,827,103 | 9/1974 | Nordeen et al. . | |
| 3,872,777 | 3/1975 | Mastis . | |
| 4,006,506 | 2/1977 | Burgoon | 15/320 |

*Primary Examiner*—Edward L. Roberts

*Attorney, Agent, or Firm*—Price, Heneveld, Huizenga & Cooper

[57] ABSTRACT

The specification discloses a floor scrubber wherein the squeegee is connected to the machine by a coil spring. The squeegee is free of direct rigid connection to the machine such that it can shift readily from side to side through the action of the spring. The squeegee is biased to a raised position by a second spring and can be forced downwardly into engagement with the floor through a unique pneumatic cylinder.

30 Claims, 4 Drawing Figures

FLOOR TREATING MACHINE WITH SQUEEGEE

BACKGROUND OF THE INVENTION

The present invention relates to floor treating machines, particularly to scrubbers with squeegees. Scrubbers lay down a cleaning solution at the front of the machine and brushes located generally towards the front of the machine proceed to scrub the floor with the cleaning solution. A squeegee, typically V-shaped in plan view, follows at the rear of the machine and wipes solution off the floor. Through its shape, it funnels the solution towards a vacuum port wherein solution is drawn up and deposited in a recovery tank on the machine.

One problem with prior art scrubbers is that the squeegee has to be quite wide, sometimes wider than the machine. When it hits walls, articles of furniture or the like, it tends to damage them.

Another problem is that when one turns the corner, the squeegee often does not trail properly behind the machine, thereby leaving puddles of water on the floor at the corners.

Yet another problem is insuring even pressure of the squeegee against the floor. This becomes particularly difficult to deal with when the squeegee travels over deviations in the floor.

Prior art squeegee mechanisms are typically complicated and often do not provide solutions to the above problems. Some provide solutions to only some of the problems while ignoring others completely. Thus, Cain, U.S. Pat. No. 3,209,716 issued Dec. 13, 1966 provides a universal joint to join the squeegee support arm to the machine to facilitate proper trailing, but does not attempt to insure equal pressure of the squeegee on the floor and does not prevent the squeegee blade from getting hung up on a corner and damaging woodwork or the like. The patent to Arones, U.S. Pat. No. 3,065,490 is typical of rather complicated prior art mechanisms which keep pressure on the squeegee through some type of spring. Daniels, et. al. U.S. Pat. No. 3,206,787 which issued Sept. 21, 1965 utilizes a spring to bias the squeegee mechanism upwardly, but provides no satisfactory mechanism for applying downward pressure on the squeegee.

Little, et. al. U.S. Pat. No. 3,277,511 which issued Oct. 11, 1966 and Burgoon, U.S. Pat. No. 4,006,506 which issued Feb. 8, 1977 also illustrate other complicated prior art squeegee linkage mechanisms. None really solve all the problems discussed above.

SUMMARY OF THE INVENTION

In the present invention the squeegee is connected to the floor treating machine by a spring means capable of at least a side to side bending, spring action with the squeegee being free of any direct, rigid connection to the machine. Thus, the squeegee is free to flex out of the way of corners or other protrusions such that damage thereto is minimized. Similarly, the squeegee tends to track properly behind the machine as it corners.

In another aspect of the invention, the squeegee is normally biased into an upward position and is forced downwardly against the surface being treated through a pneumatic means. This helps to insure that the squeegee will exert an even pressure on the floor being treated even as it passes over deviations in the floor and even as the center of gravity of the machine shifts from side to side (for whatever reason).

These and other objects, advantages and features of the invention will be more fully understood and appreciated by reference to the written specification and appended drawings.

DESCRIPTION OF THE PREFERRED EMBODIMENT

Figure 1:
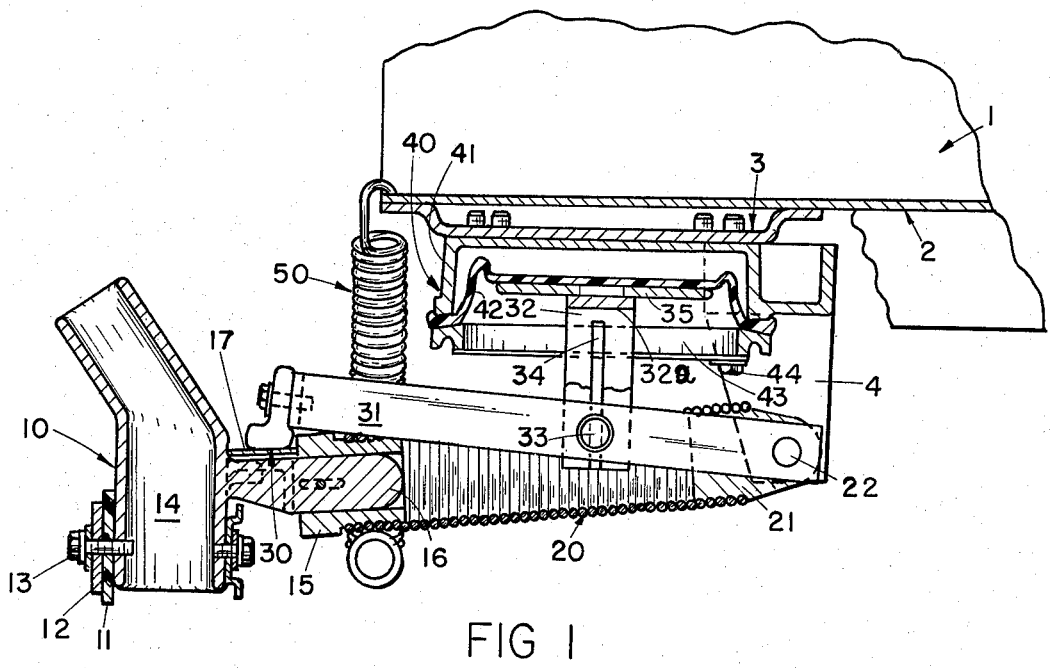
FIG. 1 is a partially cross sectional view of the rear portion of the floor scrubber of the present invention with the arm 31 shown not sectioned and with the squeegee in a down position engaging the floor.
Figure 2:
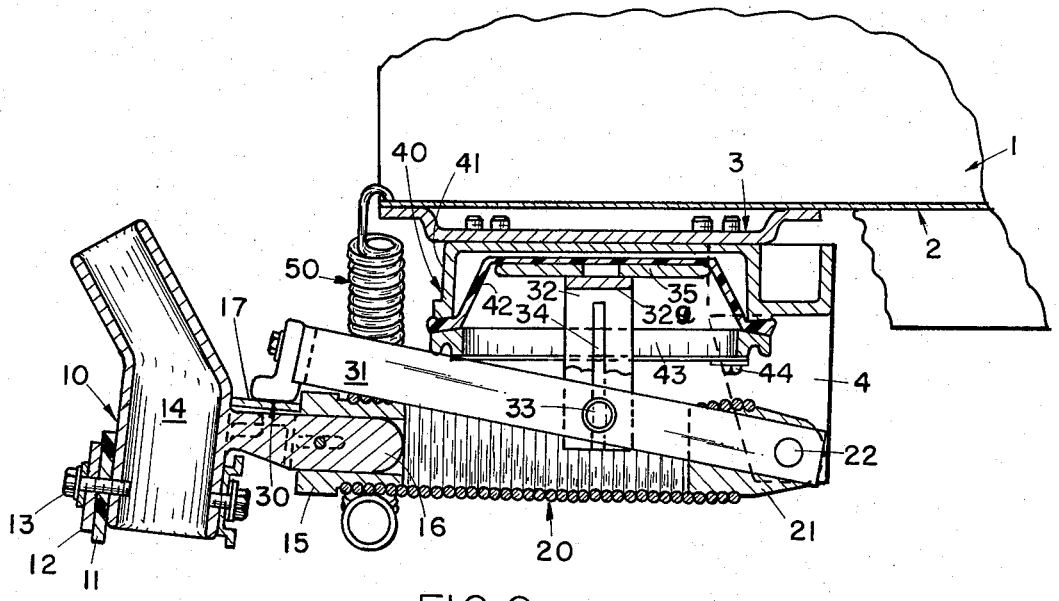
FIG. 2 is the same partial cross sectional view as FIG. 1 with the squeegee in its up position.

In the preferred embodiment, squeegee assembly 10 is joined to machine 1 (only the rear bottom corner of which is shown) by means of coil spring 20 (FIGS. 1 and 2). It is normally urged upwardly by a bias spring 50. Squeegee 10 can be forced downwardly through the action of pneumatic cylinder 40 on an arm 31 having a pressure pad 30 mounted on one end thereof. Pressure pad 30 engages the top of squeegee assembly 10 in a slidable manner such that squeegee 10 is free to shift from side to side in spite of its engagement by pressure pad 30.

Figure 3:
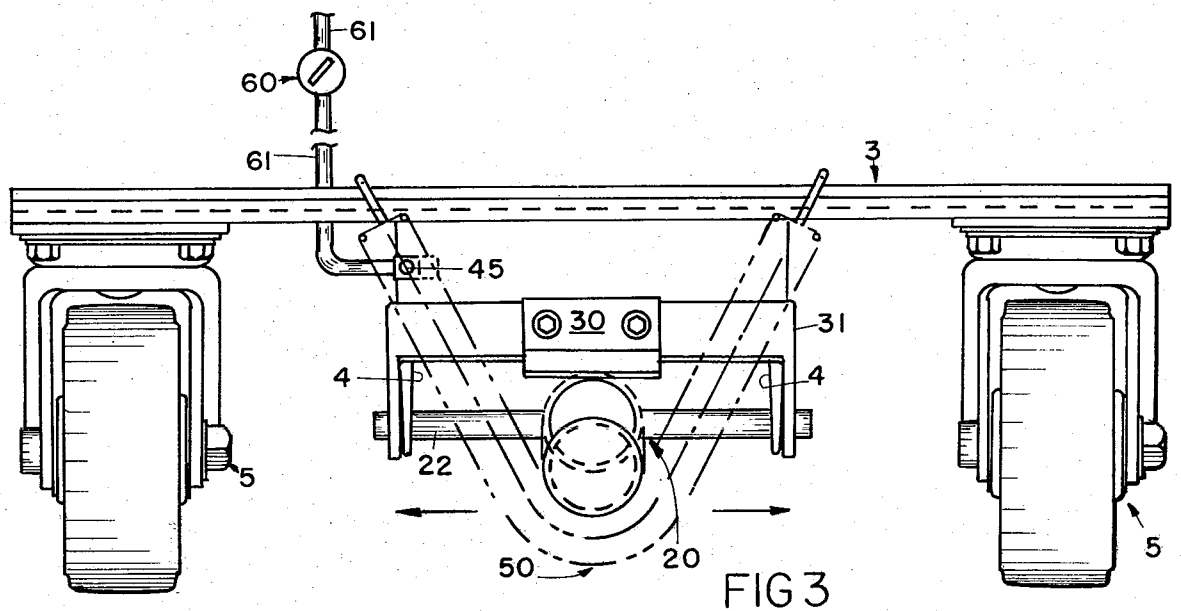
FIG. 3 is a rear elevational view of the bottom portion of the machine with the squeegee per se removed, showing the squeegee connecting aperatus.

The entire squeegee assembly is supported on a caster support beam 3 which in turn is bolted to machine frame 2 (FIGS. 1 and 3). Casters 5 are also mounted on caster support beam 3 generally on either side of the squeegee support linkage.

Figure 4:
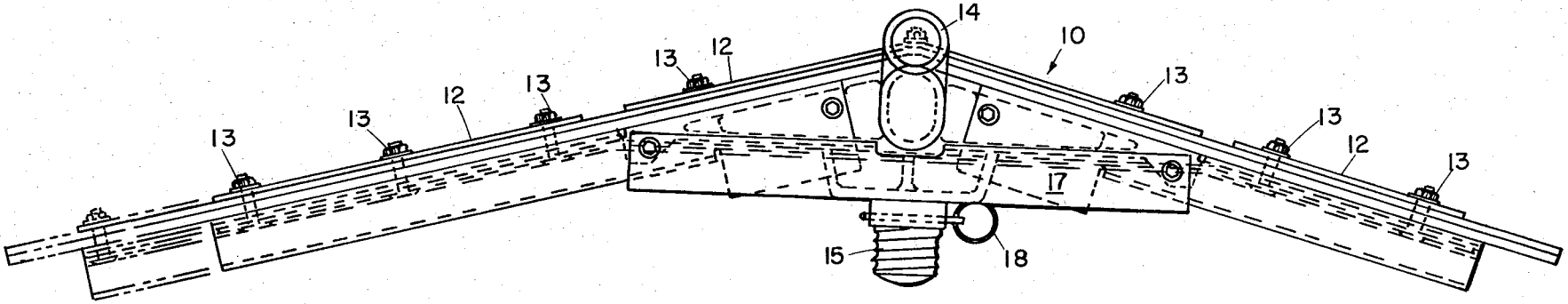
FIG. 4 is a top plan view of the squeegee per se.

Squeegee assembly 10 includes a wiper blade 11 and a clamp 12 which is used to clamp wiper blade 11 in place with the assistance of bolt assemblies 13. (FIGS. 1, 2 and 4). This arrangement is generally conventional.

The squeegee assembly 10 is generally V-shaped so that water is funneled to a vacuum port 14 generally at the center of squeegee 10.

Protruding from the front of squeegee 10 is an integrally formed plug 16 which fits within a coupling 15. Coupling 15 is threaded such that coil spring 20 can be threaded thereto. A release pin 18 extends through coupling 15 and plug 16 to hold squeegee 10 in place. Squeegee 10 can be removed by pulling pin 18 out and removing plug 16 from the interior of coupling 15.

Positioned above plug 16 and extending laterally between both legs of the "V" formed by squeegee 10 is a rub plate 17. It is rub plate 17 which is engaged by pressure pad 30.

Coil spring 20 is a relative heavy spring having a diameter of approximately $1\frac{3}{4}$". The type of coil spring used in garage door mechanisms would suitably serve as coil spring 20.

Coil spring 20 is threaded at one end over coupling 15 and at the other end over pivot mount coupling 21. Pivot mount coupling 21 is in turn mounted on a pivot axle 22 which extends between two downwardly projecting pivot brackets 4 (FIGS. 1–3). Pivot brackets 4 are in turn secured to caster support beam 3 and can advantagously be formed integrally with the main body of pneumatic cylinder 50. Through this pivotal mounting, coil spring 20 is free to pivot up or down about pivot axle 22.

Coil spring 20 will of course exhibit a spring action in any direction in a plane extending laterally of the direction of travel of machine 1. It will also expand somewhat in a fore and aft direction. As such, coil spring 20 provides an ideal mechanism and a most preferred mechanism for use in the present invention.

However, it is conceivable that other spring means could be utilized, particularly if they exhibit at least a bending, side by side spring action. Such an action allows the squeegee 10 to flex out of the way of a corner or other object when one side of it gets caught on that corner or other object. This bending action is definately enhanced by a coil spring wherein the coil spring would actually expand along one side if one edge of the squeegee 10 got hung up.

Pressure pad 30 is preferably made of a selflubricated plastic material. This causes it to slide more readily against rub plate 17. An example of such a plastic material would be one of the nylons.

Pressure pad 30 is mounted on the base of a generally U-shaped arm 31. Each leg of arm 31 is in turn pivotally carried on pivot axle 22 (FIG. 3). In this way, arm 31 and pressure pad 30 can readily be pivoted upwardly or downwardly.

This pivotal movement of U-shaped arm 31 is controlled by pneumatic cylinder 40. The linkage is achieved through a generally U-shaped linking arm 32 having spaced downwardly depending legs and a cross piece 32*a* (shown in FIGS. 1 and 2, but not shown in FIG. 3 so as to avoid complicating FIG. 3). The end of each leg of arm 32 is pinned to one of the legs of arm 31 by link pin 33. Link pin 33 can be locked at various points within a slot 34 so that the relative elevation of arm 31 when cylinder 40 is not pressurized can be adjusted.

The base 32*a* of linkage arm 32 is in turn joined to a pad 35. Pad 35 is in turn glued to the rubber diaphram 42 of cylinder 40.

Cylinder 40 comprises a shallow inverted dish 41. A generally dish shaped flexible rubber diaphram 42 is located within dish 41 and is held in place by means of a clamping ring 43. Clamping ring 43 is in turn held in place by clamping bolts 44. When air under pressure is applied to cylinder 40, flexible rubber diaphram 42 is pushed downwardly, thereby forcing arm 31 and squeegee 10 downwardly (compare FIGS. 1 and 2). Rubber diaphram 42 is of a relatively heavy rubber material. The rubber diaphrams employed in truck air brakes would be operable in the present invention.

Protruding from cylinder 40 is a pressure line coupling connector 45 (FIG. 3). Air under pressure is fed from an air pressure source through a line 61 to connector 45 and from then into cylinder 40. A pressure regulator 60 is located within line 61 so that a constance pressure can be maintained at cylinder 40. Regulator 60 (shown schematically in FIG. 3) is adjustable so that a relative agressiveness of squeegee 10 on the floor can be adjusted.

Bias spring 50 is a relatively light spring and need only be strong enough to hold squeegee 10 in an elevated position when there is no air under pressure within cylinder 40. A screen door spring is satisfactory for this purpose. Spring 50 is secured at each end to the rear edge flange of caster support beam 3 (FIG. 3). Spring 50 then extends downwardly and passes under coil spring 20 at the point at which it is threaded onto coupling 15. As squeegee 10 shifts from side to side, it simply slides along spring 50.

In operation, cleaning solution scrubbed onto the floor at the front of machine 1 is funneled inwardly towards vacuum port 14 by the generally V-shaped wiper blade 11 of squeegee 10. The liquid is then drawn up through vacuum port 14 and through a conduit to a recovery tank mounted on machine 1. Air is supplied to cylinder 40 through a pressure regulator 60 (FIG. 3) such that the pressure within cylinder 40 is always constant. This insures that squeegee 10 will exert a constant pressure against the floor being cleaned regardless of deviations in the floor. By adjusting pressure regulator 60, one can adjust the relative agressiveness of squeegee 10 on the floor.

As one turns machine 1 around a corner, the frictional engagement of wiper blade 11 on the floor will tend to cause squeegee 10 to want to take the shortest possible path around the corner. Coil spring 20 will flex to one side as rub plate 17 slides beneath pressure pad 30, thereby allowing squeegee 10 to do so. This constitutes the proper path for squeegee 10 to follow in order to maximize the recovery of cleaning solution being laid down by machine 1.

If squeegee 10 catches on a corner or other protruding objects, coil spring 20 will bendably flex to one side thereby allowing squeegee 10 to slide past the object without causing excessive damage to it.

When it is desired to raise squeegee 10, one merely exhausts pressure from the line to cylinder 40, thereby causing biasing spring 50 to raise squeegee 10.

Of course, it is understood that the above is merely a preferred embodiment of the invention and that various changes and alterations can be made without departing from the spirit and broader aspects thereof as set forth in the appended claims which are to be interpretted in accordance with accepted principles of patent law.

The embodiments of the invention in which an exclusive property or privilege is claimed are defined as follows.

1. A floor treating machine, with a squeegee operably connected thereto for selective engagement or disengagement with the surface being treated, in which the improvement comprises: spring means, capable of flexing spring action in at least a side to side direction laterally of the direction of travel of the machine, secured at one end to said machine and at the other end to said squeegee, said squeegee being free of connection to said machine through a rigid linkage whereby it is free to shift laterally side to side not only relative to said machine but also relative to the normal longitudinal axis of said spring means through said flexing action of said spring means thereby allowing said squeegee to deflect out of the way of obstacles and not get hung up on corners or the like.

2. The floor treating machine of claim 1 wherein said spring means is capable of spring action in any lateral direction as well as expansion in a fore and aft direction.

3. The floor treating machine of claim 1 in which said spring means comprises a coil spring.

4. The floor treatment machine of claim 1, 2 or 3 which includes: a pressure pad slidably engaging the top of said squeegee; means for raising and lower said pressure pad whereby when said pressure pad is lowered, it forces said squeegee against the floor while still allowing it to shift from side to side.

5. The floor treatment machine of claim 4 which includes means biasing said squeegee upwardly against said pressure pad.

6. The floor treatment machine of claim 5 wherein said means for raising and lowering said pressure pad comprises pneumatic cylinder means operably connected thereto.

7. The floor treatment machine of claim 6 wherein said pneumatic cylinder means comprises a relatively shallow dish shaped cylinder with a rubber diaphram seated therein whereby said diaphram expands outwardly when air under pressure is delivered to said cylinder.

8. The floor treatment machine of claim 7 wherein said bias means comprises a second spring.

9. The floor treatment machine of claim 8 wherein said second spring is secured at each end to said machine and extends under said first spring means.

10. The floor treatment machine of claim 9 wherein said first spring means is pivotally connected to said machine for pivotal up and down movement with respect thereto.

11. The floor treatment machine of claim 7 wherein said cylinder means is operably connected to a pressure regulator for insuring a constant pressure of said cylinder means.

12. The floor treatment machine of claim 6 wherein said cylinder means is operably connected to a pressure regulator for insuring a constant pressure of said cylinder means.

13. The floor treatment machine of claim 6 wherein said bias means comprises a second spring secured at each end to said machine and extending under said first spring means.

14. The floor treatment machine of claim 5 wherein said bias means comprises a second spring, said second spring is secured at each end to said machine and extends under said first spring means.

15. The floor treatment machine of claim 5 wherein said first spring means is pivotally connected to said machine for pivotal up and down movement with respect thereto.

16. The floor treatment machine of claim 4 wherein said pressure pad is made of a self lubricating plastic material.

17. The floor treatment machine of claim 4 wherein said first spring means is pivotally connected to said machine for pivotal up and down movement with respect thereto.

18. The floor treatment machine of claim 1 wherein said spring means is pivotally connected to said machine for pivotal up and down movement with respect thereto.

19. A floor treatment machine, with a squeegee operably connected thereto for selective engagement or disengagement with the surface being treated, in which the improvement comprises: a coil spring pivotally connected to said machine at one end for up and down pivotal movement; said squeegee means being connected to said coil spring at the opposite end of said coil spring, said squeegee being free of direct rigid connection to said machine whereby it is free to shift laterally through action of said coil spring; an arm pivotally mounted at one end to said machine; a pressure pad positioned at the opposite end of said arm from said pivot mounting, said pressure pad engaging the top of said squeegee; biasing means operably connected between said squeegee and said machine for biasing said squeegee upwardly towards engagement with said pressure pad, said biasing means also biasing said squeegee and said arm upwardly such that said squeegee is disengaged from the surface being treated; pneumatic cylinder means operably connected to said arm at a point spaced from said pivot mounting thereof whereby when air under pressure is fed to said pneumatic cylinder means, said arm is forced downwardly and said squeegee is forced downwardly until it engages the floor being treated.

20. The floor treatment machine of claim 19 wherein said cylinder means is operably connected to a pressure regulator for insuring a constant pressure of said cylinder means.

21. The floor treatment machine of claim 19 or 20 wherein said pressure pad is made of a self lubricating plastic material.

22. The floor treatment machine of claim 19 or 20 wherein said arm and said coil spring are pivotally mounted on said machine on a common pivot axis.

23. The floor treatment machine of claim 20 wherein said squeegee includes a rub plate mounted atop thereof, said pressure pad slidably engaging said rub plate.

24. A floor treating machine, with a squeegee operably connected thereto by squeegee connecting means, for selective engagement or disengagement with the surface being treated, in which the improvement comprises: means biasing said squeegee upwardly out of engagement with the surface being treated; pneumatic cylinder means operably connected to said squeegee for selectively forcing same down when pressurized or allowing said bias means to force said squeegee upwardly when said pneumatic cylinder means is depressurized; said pneumatic cylinder means comprising a relatively shallow dish shaped cylinder with a rubber diaphram seated therein whereby said diaphram expands outwardly when air under pressure is delivered to said cylinder.

25. The floor treating machine of claim 25 wherein said rubber diaphragm is dish shaped generally to the shape of interior of said dish shaped cylinder.

26. The floor treating machine of claim 24, or 25 wherein said cylinder means is operably connected to a pressure regulator for insuring a constant pressure of said cylinder means.

27. The floor treating machine of claim 26 wherein said pneumatic cylinder means is operably connected to an arm which is pivotally mounted to said machine; said arm resting on said squeegee means at a point spaced from said pivotal mounting of said arm; said biasing means comprising spring means operably connected at each end to said machine and passing under said squeegee connecting means.

28. The floor treating machine of claim 27 wherein said arm includes a pressure pad mounted thereon, said pressure pad engaging said squeegee.

29. A floor treating machine with a squeegee operably connected thereto for selective engagement or disengagement with the surface being treated, in which the improvement comprises: flexible linkage means interconnecting said machine and said squeegee, said flexible linkage means having a normal longitudinal axis and comprising means allowing said flexible linkage means and said squeegee to shift laterally of the direction of travel of said machine and means allowing said squeegee to shift laterally relative to the normal longitudinal axis of said flexible linkage means, thereby allowing said squeegee to deflect out of the way of obstacles and not get hung up on corners or the like.

30. The floor treating machine of claim 29 in which said means allowing said linkage means and said squeegee to deflect laterally of the direction of travel of said machine and said means allowing said squeegee to deflect laterally with respect to the normal longitudinal axis of said linkage means both comprise said linkage means being a coil spring, said squeegee being free of connection to said machine through a rigid linkage.

* * * * *